US011273941B2

(12) United States Patent
Uetsuki et al.

(10) Patent No.: US 11,273,941 B2
(45) Date of Patent: Mar. 15, 2022

(54) HEAT-SHRINKING APPARATUS FOR SHRINK LABELS

(71) Applicants: KABUSHIKI KAISHA YAKULT HONSHA, Tokyo (JP); TOHO SHOJI KABUSHIKI KAISHA, Osaka (JP); FUJI SEAL, INC., Osaka (JP)

(72) Inventors: Akira Uetsuki, Osaka (JP); Osamu Sekiguchi, Tokyo (JP); Toshiyuki Harada, Tokyo (JP)

(73) Assignees: KABUSHIKI KAISHA YAKULT HONSHA, Tokyo (JP); TOHO SHOJI KABUSHIKI KAISHA, Osaka (JP); FUJI SEAL, INC., Osaka (JP)

( * ) Notice: Subject to any disclaimer, the term of this patent is extended or adjusted under 35 U.S.C. 154(b) by 374 days.

(21) Appl. No.: 15/317,263

(22) PCT Filed: Jun. 26, 2015

(86) PCT No.: PCT/JP2015/068511
§ 371 (c)(1),
(2) Date: Dec. 8, 2016

(87) PCT Pub. No.: WO2015/199221
PCT Pub. Date: Dec. 30, 2015

(65) Prior Publication Data

US 2017/0129634 A1 May 11, 2017

(30) Foreign Application Priority Data

Jun. 27, 2014 (JP) ..... JP2014-132659

(51) Int. Cl.
*B65B 53/06* (2006.01)
*B65B 53/00* (2006.01)
*B65B 61/20* (2006.01)

(52) U.S. Cl.
CPC ..... *B65B 53/06* (2013.01); *B65B 53/00* (2013.01); *B65B 53/063* (2013.01); *B65B 61/202* (2013.01)

(58) Field of Classification Search
CPC ..... B65B 53/00; B65B 53/06; B65B 53/063; B65B 53/066; B65C 3/065
See application file for complete search history.

(56) References Cited

U.S. PATENT DOCUMENTS 2,904,943 A * 9/1959 Dreyfus ..... B65B 53/06 156/85
3,349,502 A * 10/1967 Kiefer ..... B65B 53/063 34/216

(Continued)

FOREIGN PATENT DOCUMENTS

CN 2237000 Y 10/1996
CN 202557868 U 11/2012

(Continued)

OTHER PUBLICATIONS

Chinese Office Action for CN Patent Application No. 201580034456.2, dated May 3, 2018 (7 Sheets).

(Continued)

*Primary Examiner* — Robert F Long
*Assistant Examiner* — Eduardo R Ferrero
(74) *Attorney, Agent, or Firm* — Kratz, Quintos & Hanson, LLP

(57) ABSTRACT

The purpose of the present invention is to provide a heat-shrinking apparatus for shrink labels which is capable of uniformly heat shrinking a shrink label covering a portion or the entirety of an article, and which is capable of completing heat shrinking in a state in which water drops are not deposited on the article and the surface of the shrink label. Accordingly, the present invention is provided with: a heat treatment chamber (2) having, provided therein, a steam (Continued)

discharge unit (12) for discharging superheated steam in order to heat shrink a cylindrical label (L) fitted to a container (PC), and a heated air blowing unit (14) for causing deposited water drops to evaporate by blowing heated air on the container (PC) after the cylindrical label (L) has been heat shrlUlk; a superheater (22) which heats steam generated by a steam boiler (20), to generate the superheated steam; a preheating lUlit (27) which uses the surplus steam inside the heat treatment chamber (2) to preheat air used to generate the heated air; a heated-air-generating heat exchanger (15) which uses steam to heat the preheated air to a prescribed temperature; and a condensing heat exchanger (31) for condensing the surplus steam.

8 Claims, 8 Drawing Sheets

(56) References Cited

U.S. PATENT DOCUMENTS 3,744,146 A * 7/1973 Nichols ..... B65B 53/063 34/212
4,765,121 A * 8/1988 Konstantin ..... B65B 9/13 53/442
4,773,109 A * 9/1988 Reinehr ..... D06C 7/00 8/149.3
5,062,217 A * 11/1991 Tolson ..... B65B 53/063 34/216
5,400,570 A * 3/1995 Bennett ..... B65B 53/04 34/216
5,759,337 A * 6/1998 Fujio ..... B29C 63/426 156/356
5,787,682 A * 8/1998 Tolson ..... B65B 53/063 53/442
D481,049 S * 10/2003 Limousin ..... D15/145
6,691,439 B1 * 2/2004 Miyashita ..... B65D 23/0878 40/310
7,807,255 B2 * 10/2010 Tsuchida ..... B32B 7/02 428/195.1
8,235,712 B1 8/2012 Lewis
8,863,806 B2 * 10/2014 Koolhaas ..... B65C 3/065 156/540
2004/0123566 A1 * 7/2004 Limousin ..... B65B 53/063 53/442
2005/0193690 A1 * 9/2005 Schoeneck ..... B23K 26/0665 53/557
2006/0222874 A1 * 10/2006 Umeda ..... B32B 7/10 428/483
2007/0087191 A1 * 4/2007 Kaya ..... B65D 23/085 428/343
2008/0148691 A1 * 6/2008 Elsperger ..... B65B 53/066 53/442
2010/0032077 A1 * 2/2010 Uetsuki ..... B65B 53/063 156/86
2010/0077702 A1 * 4/2010 Lelie ..... F23D 14/16 53/442
2010/0293901 A1 * 11/2010 Malthouse ..... B65B 53/06 53/557
2011/0126960 A1 * 6/2011 Orlandi ..... B65C 3/065 156/84
2011/0179751 A1 * 7/2011 Caudwell ..... B65B 53/04 53/427
2011/0240588 A1 * 10/2011 Terrasi ..... B29C 63/423 215/40
2013/0000256 A1 * 1/2013 Schilling ..... F27B 9/10 53/442
2014/0014272 A1 * 1/2014 Fresnel ..... B65B 53/066 156/497
2014/0041341 A1 * 2/2014 Koolhaas ..... B29C 63/423 53/442
2015/0040520 A1 * 2/2015 Landolt ..... F28D 21/0014 53/442
2016/0083134 A1 * 3/2016 Vissa ..... B65B 53/063 156/85
2016/0122058 A1 * 5/2016 Smith ..... F27B 9/24 53/557

FOREIGN PATENT DOCUMENTS

EP 2103527 A1 9/2009
JP H04-60810 U1 5/1992
JP H09-150812 A 6/1997
JP H09-272514 10/1997
JP 2010-202246 A 9/2010
WO 2003093114 A1 11/2003

OTHER PUBLICATIONS

Extended European Search Report for counterpart EPC Patent Application No. 15811117.9 dated Jan. 19, 2018 (6 Sheets).
International Search Report for International Application No. PCT/JP2015/068511 dated Sep. 1, 2015.

* cited by examiner

HEAT-SHRINKING APPARATUS FOR SHRINK LABELS

TECHNICAL FIELD

The present invention relates to a heat-shrinking apparatus for shrink labels for heat-shrinking cylindrical shrink labels and the like being fitted to a plastic container in which a liquid drink, for example, is to be filled.

BACKGROUND ART

Plastic containers in which a liquid drink such as a soft drink is to be filled include ones to which a product name or indication of contents and the like are directly printed on a container surface and ones to which a cylindrical shrink label on which the product name or indication of the contents and the like are printed is attached to the plastic container in order to change design easily. In such cylindrical shrink labels it is usual that such labels are attached to the plastic containers continuously by means of a label attachment system including a conveyer for conveying the plastic container along a predetermined conveyance path, a label fitting device for fitting an unshrunk cylindrical label to the plastic container being conveyed by the conveyer and a heat-shrinking device for heat-shrinking the cylindrical label being fitted to the plastic container.

The heat-shrinking device mounted on such a label attachment system includes a heating treatment chamber installed so as to surround the conveyer for conveying the container to which the cylindrical label is fitted and a heating device for heating the cylindrical label being fitted to the container by hot air or steam while the container passes through the heating treatment chamber, and therefore, it is constructed such that the cylindrical label is heat-shrunk while the container passes through the heating treatment chamber (Patent Literature 1). The term "steam" used in the present application means steam a temperature of which is 100° C. or less under a condition of 1 atmospheric pressure.

CITATION LIST

Patent Literature

Patent Literature 1: Not Examined Japanese Patent Application Publication No. 09-272514 (JPA H09-272514)

SUMMARY OF INVENTION

Problems to be Solved by Invention

In a case that the cylindrical label is to be heated by hot air, since the air being heated by a heater, a temperature of which air is approximately 100 to 200° C., is locally blown to the cylindrical label fitted to the plastic container, it is difficult to heat-shrink the entire cylindrical label uniformly, and therefore, there is a problem that a design or a character being printed on the cylindrical label is distorted and cannot be easily finished beautifully.

On the other hand, in a case that the cylindrical label is heated by steam, since the entire cylindrical label can be heat-shrunk uniformly, the design or the character printed on the cylindrical label is less likely to distort and can be finished beautifully, but there is a problem that a large quantity of water drops are deposited to the surface of the cylindrical label or the plastic container. In a case that the cylindrical label is to be attached to the plastic container before the contents such as a liquid drink are to be filled, since a large quantity of water drops is also deposited to an inside of the plastic container, it becomes a serious problem.

Thus, an object of the present invention is to provide a heat-shrinking apparatus for shrink labels which can uniformly heat-shrink the shrink label covering a part of or the whole of an article, and moreover, can finish into a condition that water drops are not deposited on the surfaces of the article or the shrink label.

Means for Solving the Problem

In order to solve the above-mentioned problems, an invention according to claim 1 provides a heat-shrinking apparatus for shrink labels comprising a heating treatment chamber surrounding a conveyance path of a label covered body in which a part of or the whole of an article is covered by a shrink label, a steam supply device that heat-shrinks the shrink label of the label covered body passing through the heating treatment chamber by supplying superheated steam into the heating treatment chamber, a heated air generating device that generates heated air at a predetermined temperature, and a heated air blowing device that evaporates water drops by blowing the heated air generated by the heated air generating device to the label covered body on which the water drops are deposited due to passage through the heating treatment chamber to which the superheated steam is supplied, the heated air generating device having a preheating device that preheats the air by using surplus steam in the heating treatment chamber and a heating device that heats the air being preheated by the preheating device to a predetermined temperature. In the present application, the phrase "superheated steam" means a steam at a temperature higher than 100° C. and a temperature equal to or lower than 300° C. under a condition of 1 atmospheric pressure, preferably at 120 to 300° C., more preferably at 160 to 180° C., the phrase "superheated steam" is different from the above-mentioned "steam".

Moreover, an invention according to claim 2 comprises a steam condensing device that condenses the surplus steam in the heating treatment chamber by cooling the surplus steam in the heat-shrinking apparatus for shrink labels of the invention according to claim 1.

Effect of Invention

As described above, in the heat-shrinking apparatus for shrink labels of the invention according to claim 1, since the shrink label covering a part of or the whole of the article is heat-shrunk by the superheated steam being supplied into the heating treatment chamber, similarly to a case that the shrink label is heated by steam, the design or character printed on the shrink label is less likely to distort and can be finished beautifully.

Moreover, although steam condenses easily and releases latent heat (enthalpy of evaporation), superheated steam does not condense at all until temperature thereof lowers to a saturation temperature even though a part of the enthalpy decreases, and thus, water drops are not deposited on the surface of the label covered body, different to a case that a heating by steam is carried out. Moreover, when the superheated steam being supplied into the heating treatment chamber is brought into contact with the surface of the label covered body, there are possibilities that the temperature lowers to the saturation temperature or less, and that a few water drops are deposited on the surface of the label covered body, however, such a few water drops are evaporated by blowing the heated air at a predetermined temperature from the heated air blowing device, and thereby, the shrink label can be attached to the article in a condition that no water drops are deposited on the surface of the label covered body. Therefore, the present invention can be applied to a case that, after the cylindrical shrink label is attached to the plastic container in an empty state, the contents are to be filled successively, and the present invention can be applied to fill food in a cup for which moisture should be avoided, to paper containers, containers to which a paper label is attached and the like.

Moreover, since the heated air generating device includes the preheating device for preheating the air by using the surplus steam in the heating treatment chamber and being discharged from the heating treatment chamber, the heated air at the predetermined temperature to be blown to a few water drops deposited on the label covered body in order to evaporate the few water drops can be generated efficiently, and energy efficiency is also good.

Moreover, a superheated steam is:

1) different from a steam a temperature of which is equal to or lower than 100° C., the supply temperature thereof can be set freely in a temperature region exceeding 100° C.;

2) since heat capacity is larger than that of the heated air, as compared with a heating by heated air at the same temperature, a superheated steam is able to heat a heated article rapidly; and 3) since heat of the superheated steam is transferred by convection, radiation and dew condensation in a comprehensive way as compared with a case of the heated air in which heat is transferred only by convection, and moreover, the heat transfer quantity of convection of the superheated steam is more than ten times the heat quantity of the heated air, a superheated steam has a characteristic that heating efficiency is much more excellent that of the heated air.

And thereby, by setting the supply temperature of the superheated steam to be supplied into the heating treatment chamber to a temperature largely exceeding the vicinity of 100° C. which is a heat-shrinking temperature for heat-shrinking various shrink labels to a limit shrinkage rate of each of them, that is, to approximately 160 to 180° C. for example, the shrink label covering the article being entered into the heating treatment chamber is instantaneously heat-shrunk to the limit shrinking rate, which can extremely shorten passage time through the heating treatment chamber as compared with a case that heating is carried out by the heated air at the same temperature or a case that heating is carried out by steam. Therefore, a length of the heating treatment chamber can be shortened, and space-saving of the heat-shrinking apparatus can be small. Moreover, a steam supply quantity can be reduced as compared with a case that heating is carried out by steam.

Moreover, in a case that the surplus steam is discharged to an outside in a state as it is, the surplus steam is emitted to outdoors in a smoky state from a funnel. However, since the heat-shrinking apparatus for shrink labels of the invention according to claim 2 includes the steam condensing device for cooling and then condensing the surplus steam in the heating treatment chamber, the surplus steam can be discharged as condensed water, there are merits that the outside appearance is improved than a case in which discharge of the surplus steam to the outside is carried out in the state as it is, and that a discharge duct or the like for discharging the surplus steam is no longer necessary.

DESCRIPTION OF EMBODIMENT

Figure 1:
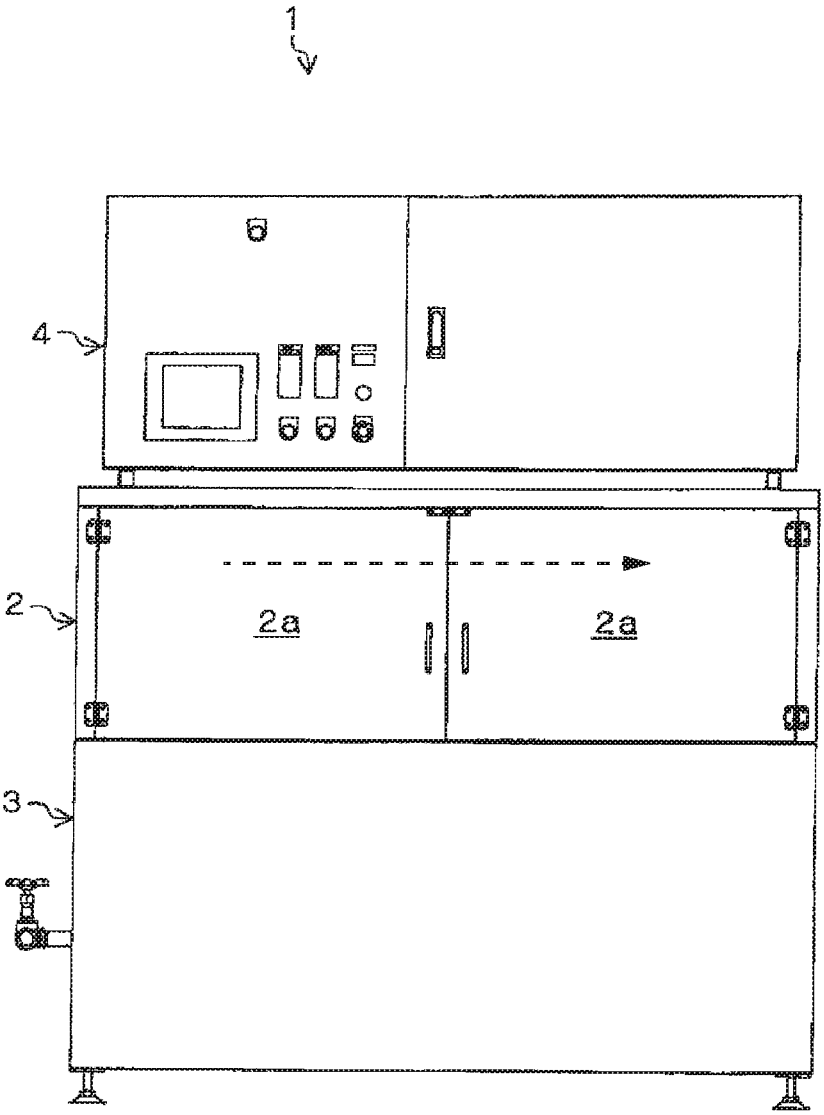
FIG. 1 is a front view illustrating an embodiment of a heat-shrinking apparatus for shrink labels according to the present invention.

An embodiment will be described below with reference to the attached drawings. FIG. 1 shows a heat-shrinking apparatus 1 for the cylindrical label L installed in a filling line of a liquid drink. In said filling line, while a plastic container (hereinafter referred to as a container) PC is conveyed by a conveyer C before a liquid drink is filled, a cylindrical shrink label L is attached to a barrel part of the container PC, and then, the liquid drink is filled in the container PC to which the cylindrical label L is attached and the container PC is sealed. By heat-shrinking the unshrunk cylindrical label L being fitted to the barrel part of the container PC in a preceding process by means of this heat-shrinking apparatus 1, said unshrunk label is closely fitted to the barrel part of the container PC.

This heat-shrinking apparatus 1 is, as shown in the same figure, constructed by a heating treatment chamber 2 through which the conveyer C for conveying the container PC passes to which container the cylindrical label L is fitted and a front surface of which chamber is capable of being opened/closed by a door 2*a*, a device integrated portion 3 in which various devices and pipelines are disposed, and a control panel 4 for controlling the various devices, and the control panel 4 is installed (mounted) on an upper part of the heating treatment chamber 2.

Said heating treatment chamber 2 includes, as shown in FIG. 2, FIG. 3, FIG. 4, FIG. 5 and FIG. 6, a heat-shrinking zone ZA for heating by using superheated steam so as to heat-shrink the cylindrical label L being fitted to the container PC and a drying zone ZB for blowing heated air in order to evaporate water drops deposited on the container PC to which the cylindrical label L is attached by heat-shrinking. In the heat-shrinking zone ZA, a cover 11 with a thickness of 1.5 mm is provided, which cover surrounds the conveyance path of the container PC to which the cylindrical label L is fitted, which cover is made of stainless and which cover is capable of being opened and closed. From a viewpoint of high heat retaining property and difficulty of dew condensation, the thickness of the cover 11 is preferably 1.5 mm rather than a cover in the prior art with a thickness of approximately 1.2 mm.

Inside the cover 11 in the heat-shrinking zone ZA, a pair of steam discharge units 12 in each of which a plurality of discharge holes 12*a* for discharging superheated steam laterally are formed on both sides in a width direction of the conveyer C, and a pair of steam discharge nozzles 13 for discharging the superheated steam upwardly on an upstream side of the pair of steam discharge unit 12, are disposed respectively. In the steam discharge unit 12, a discharge hole 12*a* is arranged so as to heat mainly a lower part of the container PC in a first half region of the container PC conveyance and to heat mainly an intermediate part and an upper part of the container PC in a second half region of the container PC conveyance.

Figure 2:
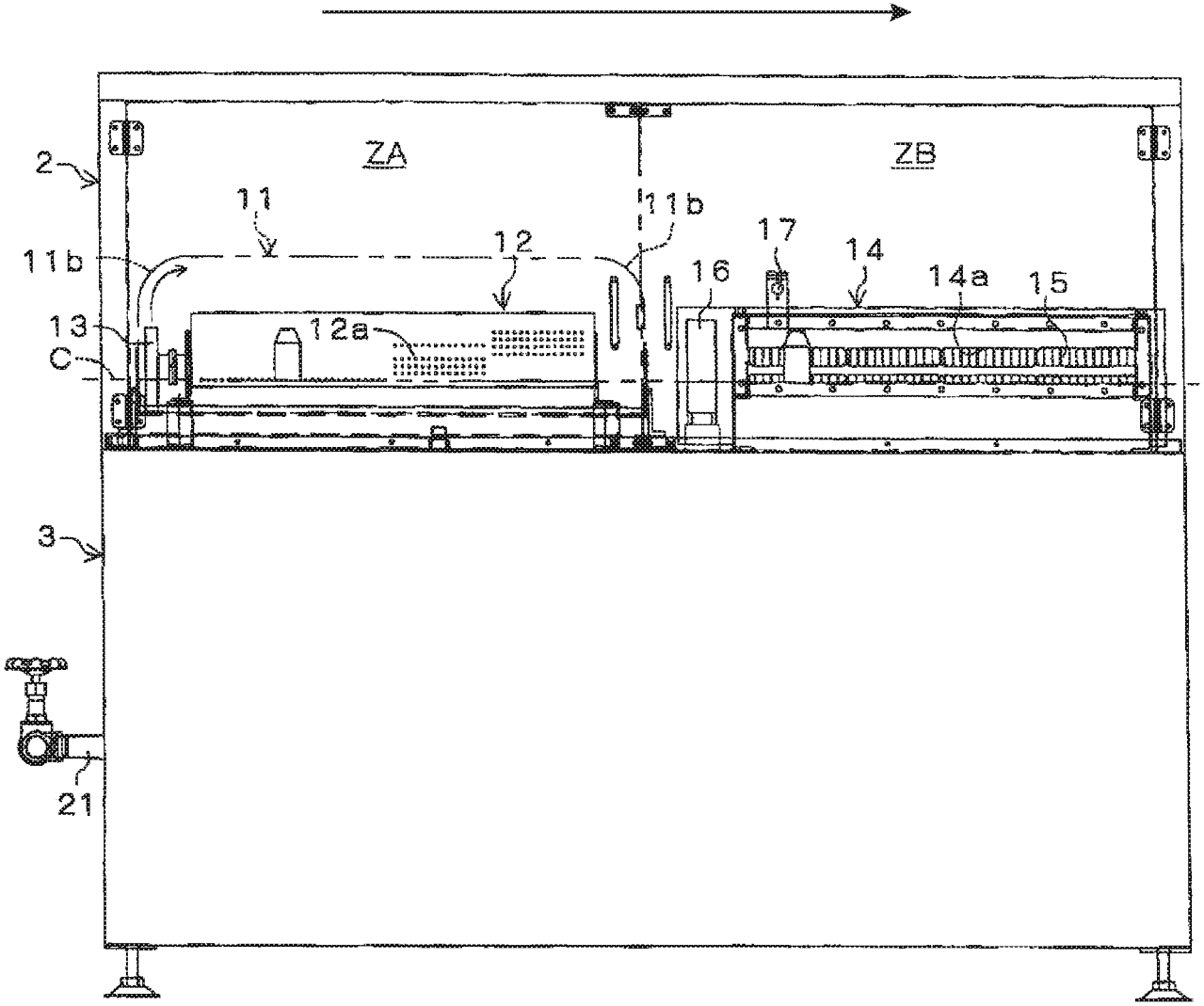
FIG. 2 is a front view illustrating an inside of a heating treatment chamber in the above-mentioned heat-shrinking apparatus.
Figure 4:
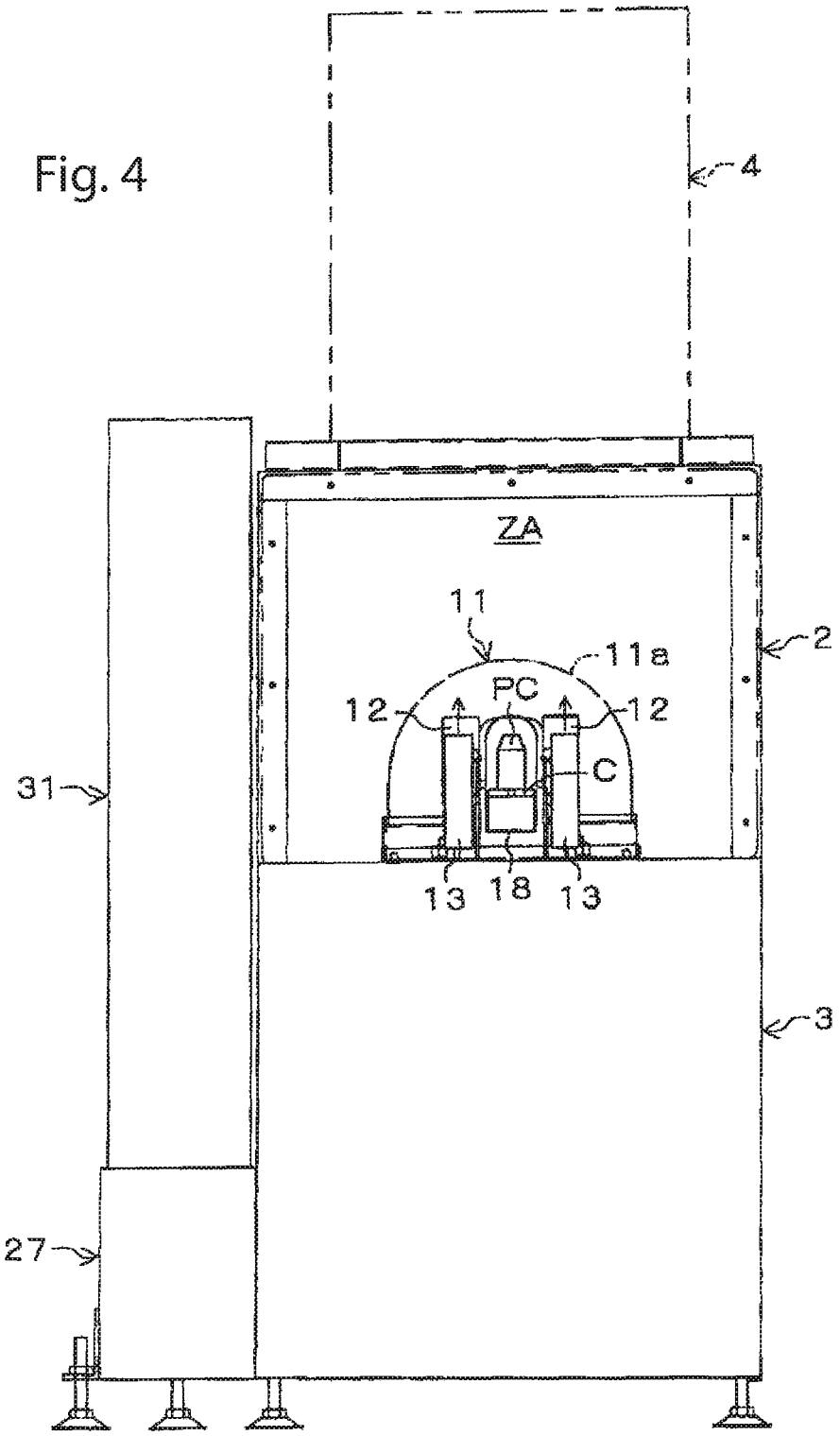
FIG. 4 is a side view in a case that an inside of the heating treatment chamber is seen from an inlet side of a container in the above-mentioned heat-shrinking apparatus.
Figure 5:
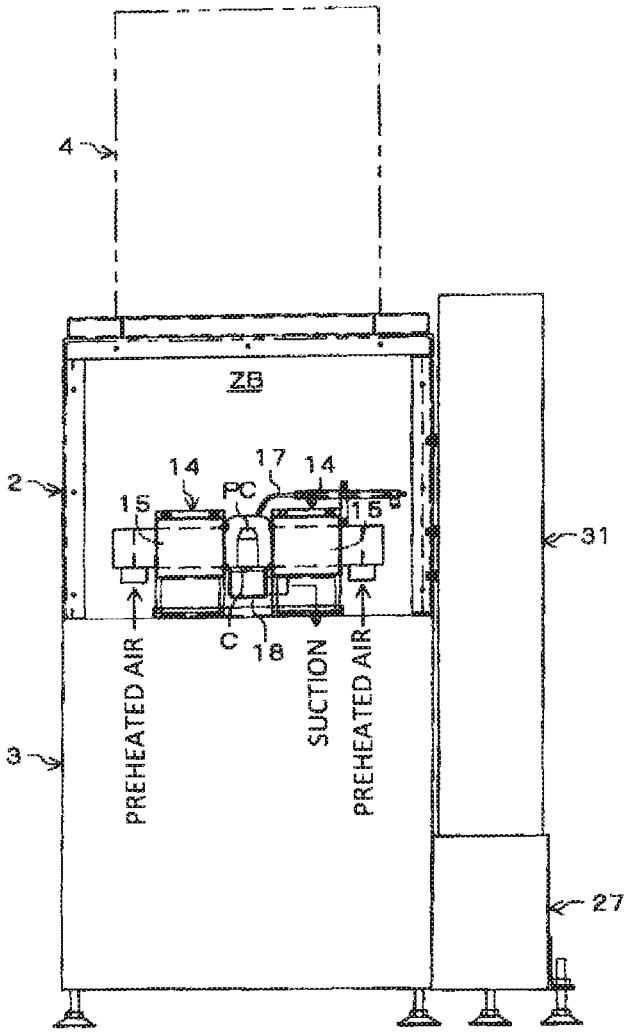
FIG. 5 is a side view in a case that the inside of the heating treatment chamber is seen from an outlet side of the container in the above-mentioned heat-shrinking apparatus.

Said cover 11 has a dome shape, and a sectional shape in a direction (width direction) being orthogonal to the conveyance direction of the container PC has a shape having an upper part 11*a* being curved as a semi-arc shape as shown in FIG. 4, and a sectional shape in the conveyance direction (longitudinal direction) of the container PC has a shape having upper-end corner parts 11*b*, 11*b* being curved in an arc shape on both end portions in the longitudinal direction, respectively, as shown in FIG. 2. The terms "semi-arc shape" and "arc shape" written in here-in-before include not only a perfect arc but also those having a trajectory of an oval or the like which does not mean a perfect circle.

A cover having a similar sectional shape in the direction orthogonal to the conveyance direction of the container is provided also in a heat-shrinking apparatus of the prior art, however, since in the prior art cover, upper end corner parts on the upstream side and a downstream side of the container in the conveyance direction have corners, dew condensation is generated on an inner surface of the upper part in the vicinity of an inlet and an outlet of the container. However, in this cover 11, since the upper end corner parts on the both end portions in the longitudinal direction have the curved shapes in the arc shape as described above, dew condensation is less likely to generate on the inner surface of the upper part of the cover 11 in the vicinity of the inlet and the outlet of the container PC.

Figure 8:
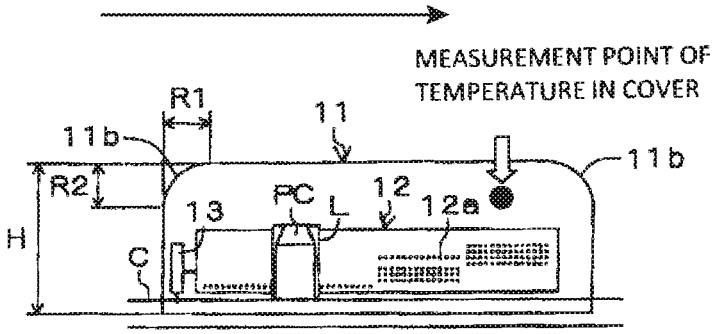
FIG. 8 is a diagram illustrating a measurement point of the temperature in the cover of the above-mentioned heat-shrinking apparatus.

Particularly, from the view point for preventing generation of dew condensation, it is preferable to curve a portion above the conveyed container PC in an arc shape entirely, in the upper end corner parts on both end portions of the cover 11 in the longitudinal direction. Specifically, as shown in FIG. 8, a region (lateral region) R1 which is a region from both end portions of the cover 11 in the length direction to at least approximately 30% of a height H of the cover 11 inward and a region (region in height direction) R2 which is region from the upper end part of the cover 11 to at least approximately 30% of the height of the cover 11 downward are preferably curved generally in an arc shape, and more preferably, the regions R1 and R2 are curved in an arc shape with a radius of curvature of 70 mm or more.

Figure 9:
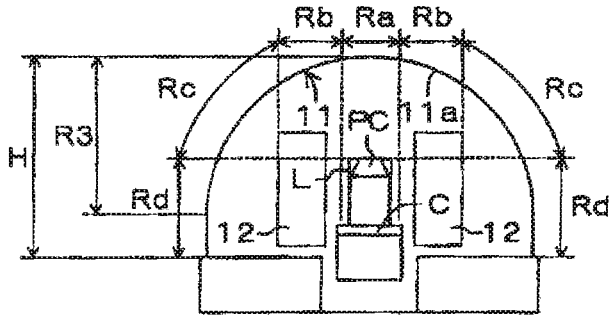
FIG. 9 is a diagram illustrating a divided region in order to evaluate dew condensation generated on an inner surface of the cover of the above-mentioned heat-shrinking apparatus.

Further, in a sectional shape in the direction (width direction) orthogonal to the conveyance direction of the container PC, it is preferable to curve a portion above the conveyed container PC in an arc shape entirely. Specifically, as shown in FIG. 9, a region (region in height direction) R3, which is a region from a top part of the cover 11 to approximately 50 to 80% of the height H of the cover 11 downward, is preferably formed in an arc shape. Also, it is more preferable to curve the region R3 in an arc shape with a radius of curvature of approximately 170 mm.

Moreover, the superheated steam is supplied to the steam discharge nozzle 13, and the superheated steam is supplied to the upstream side of the container PC in the conveyance direction in the steam discharge unit 12 through the steam discharge nozzle 13.

In this type of heat-shrinking apparatus, since a container enters into the cover with cold air, an atmospheric temperature in the cover is lower on the upstream side than on the downstream side. Moreover, in the prior art heat-shrinking apparatus, since the superheated steam is supplied to the downstream side in the conveyance direction of the container in the steam discharge unit, a discharge temperature on the upstream side in the conveyance direction of the container in the steam discharge unit is lower than the discharge temperature on the downstream side, and thus, there is a problem that dew condensation can be easily generated on the upstream side in the cover. However, in this heat-shrinking apparatus 1, as described above, the steam discharge nozzle 13 is disposed on the upstream side in the cover 11 so as to discharge the superheated steam upward, and the superheated steam is supplied to the upstream side in the conveyance direction of the container PC in the steam discharge unit 12, and therefore, the discharge temperature on the upstream side in the conveyance direction of the container PC in the steam discharge unit 12 becomes higher than the discharge temperature on the downstream side, the atmospheric temperature on the upstream side in the cover 11 is less likely to descend and the dew condensation is less likely to generate on the upstream side in the cover 11.

As described above, by raising the discharge temperature on the upstream side in the conveyance direction of the container PC in the steam discharge unit 12 higher than the discharge temperature on the downstream side, to the contrary, the atmospheric temperature on the downstream side in the cover 11 becomes easy to descend and the dew condensation can be easily generated on the downstream side in the cover 11. However, as being understood from experimental data indicated in Table 1, in a case that the operation is to be started, by starting supply of the container PC into the cover 11 after 10 minutes have elapsed since a point of time that the temperature in the cover 11 reaches 160° C., generation of dew condensation which might drop to the container PC on the downstream side in the cover 11 can be prevented.

TABLE 1

| | Condition | | | Result | | |
|---|---|---|---|---|---|---|
| Experiment No. | Warm-up time | Superheater temperature | Start completion | Dew condensation generation | Temperature in cover | Elapsed time |
| A | 10 minutes | 370 to 240° C. (tunnel temperature | 5 minutes have elapsed | X Dew condensation | 163° C. | 42 minutes |

TABLE 1-continued

| Experiment No. | Condition: Warm-up time | Condition: Superheater temperature | Condition: Start completion | Result: Dew condensation generation | Result: Temperature in cover | Result: Elapsed time |
|---|---|---|---|---|---|---|
| | | changed at 150° C.) | since temperature in cover reaches 160° C. | generation region: Rb, Rc, Rd | | |
| B | 10 minutes | 370 to 240° C. (tunnel temperature changed at 150° C.) | 10 minutes have elapsed since temperature in cover reaches 160° C. | ○ Dew condensation generation region: Rc, Rd | 163° C. | 50 minutes |

Figure 7A:
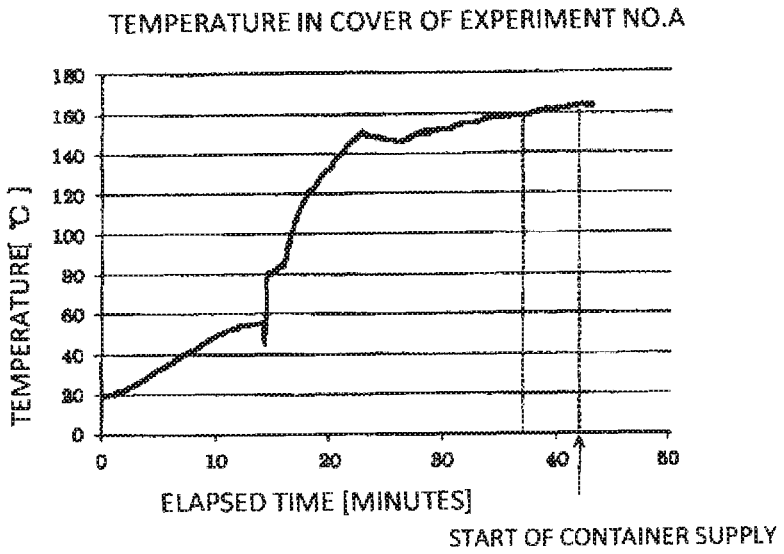
FIG. 7(*a*) is a graph illustrating fluctuation of a temperature in a cover to elapsed time at a start stage of the above-mentioned heat-shrinking apparatus in an experiment number A, and FIG. 7(*b*) is a graph illustrating fluctuation of the temperature in the cover to elapsed time at start stage of the above-mentioned heat-shrinking apparatus in an experiment number B.
Figure 7B:
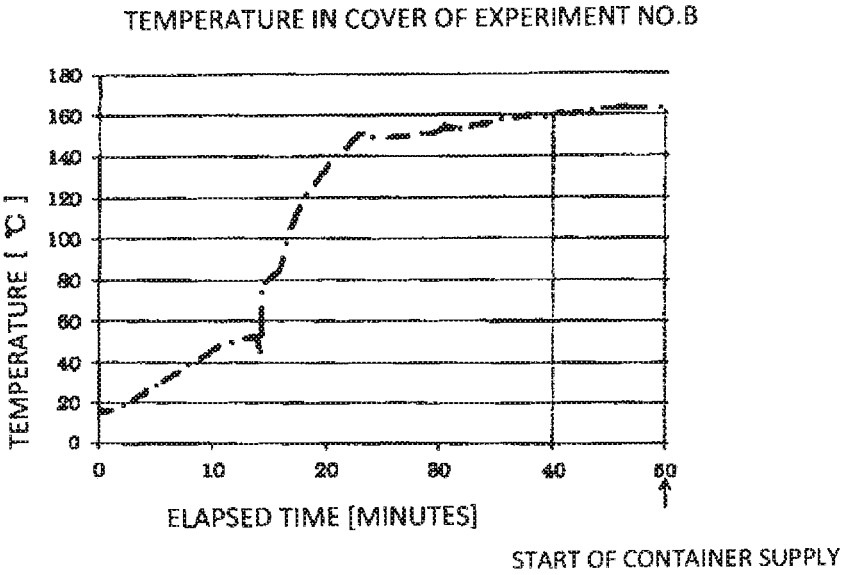

As shown in Table 1, the experiments were carried out two times. In both experiments shown in Table 1, there is common condition, that is, after a warming-up operation is carried out for 10 minutes at start operation, the inside of the cover 11 was heated in a condition that the temperature of the superheater is set to 370° C., and when the temperature inside the cover was reached 150° C., the temperature of the superheater was changed to 240° C. However, as shown in Table 1 and FIG. 7(*a*) and FIG. 7(*b*), in the experiment number A, the supply of the container PC was started after 5 minutes had elapsed(temperature inside of the cover: 163° C., elapsed time: 42 minutes) since the temperature in the cover had reached 160° C., while in the experiment number B, the supply of the container PC was started after 10 minutes had elapsed(temperature inside of the cover: 163° C., elapsed time: 50 minutes) since the temperature in the cover had reached 160° C. In the above-mentioned experiments, as shown in FIG. 8, a temperature in an upper space of the steam discharge unit 12 on the downstream side in the cover 11 was measured, and this was used as the temperature in the cover.

Regarding the experimental results, as shown in Table 1, in the experiment number A in which the supply of the container PC was started after 5 minutes had elapsed since the temperature in the cover had reached 160° C., dew condensation was generated in the regions Rb, Rc and Rd on the inner surface of the cover 11 shown in FIG. 9, while in the experiment number B in which the supply of the container PC was started after 10 minutes had elapsed since the temperature in the cover had reached 160° C., dew condensation was generated in the regions Rc and Rd on the inner surface of the cover 11, but dew condensation was not generated in the region Rb.

The region Ra on the inner surface of the cover 11 shown in FIG. 9 is positioned on a portion immediately above the conveyer C for conveying the container PC, so that in a case that condensed water is deposited in this region, it is probable that the condensed water drops and enters into the container PC, and therefore, dew condensation is not preferable. The region Rb on the inner surface of the cover 11 is positioned on the curved part immediately above the steam discharge unit 12, the condensed water deposited on this region flows down along a curved inner side surface of the cover 11 or even if it drops, the condensed water does not enter into the container PC, however, it is preferable that no condensation generates in order to reduce a risk of dropping condensed water into the container PC. The region Rc on the inner surface of the cover 11 is positioned above the mouth portion of the container PC in the curved part on the outside of the steam discharge unit 12, the condensed water deposited on this region flows down along the curved inner side surface of the cover 11, and thus, the condensed water does not enter into the container PC. The region Rd on the inner surface of the cover 11 is positioned below the mouth part of the container PC in a perpendicular part outside of the steam discharge unit 12, the condensed water deposited on this region flows down along the perpendicular inner side surface of the cover 11, and therefore the condensed water does not enter into the container PC. Thus, dew condensation in the regions Rc and Rd does not generate any problems.

As described above, if the dew condensation is not generated in the region Ra on the inner surface of the cover 11, it seems that the condensed water does not enter into the container PC. However, by giving consideration of daytime fluctuation of a condensation occurrence range (a condensation generation range) or the like, a start state of the experiment number B, in which the dew condensation was not generated in the regions Ra and Rb, was evaluated as good (proper), while the start state of the experiment number A, in which the dew condensation occurred in the region Rb, was evaluated as poor (not proper).

By means of the above-mentioned experiments, it is preferable to start the supply of the container PC at the point that 8 minutes or more, that is, approximately 8 to 12 minutes, for example, or preferably after 10 minutes have elapsed after the temperature in the cover has reached 160° C. or more, that is, to approximately 160 to 180° C., for example. In the experiment number B, since 10 minutes or more had elapsed since the temperature in the cover reached 160° C., a temperature change in the cover caused by the superheated steam had been stabilized, and the temperature in the cover can be considered to be substantially equal to the temperature of the superheated steam.

As described above, in the heat-shrinking apparatus for heat-shrinking the cylindrical label, by providing the steam discharge unit for discharging the superheated steam into the cover and by heating the cylindrical label fitted to the container passing through the cover by the superheated steam, as a construction for suppressing occurrence of dew condensation for suppressing occurrence of the dew condensation in the cover, by providing a cover shape constructed by smooth surfaces without a rapid shape change in order to make heat transfer or occurrence of the dew condensation uniform, the temperature distribution in the cover is made uniform, and even if the dew condensation is generated, an occurrence state of the dew condensation is made uniform, whereby the dew condensation, which occurred on a portion where the cover shape rapidly changes, is suppressed.

Regarding the cover, the sectional shape in the direction orthogonal to the conveyance direction of the container is made a shape in which the upper part thereof is curved in the semi-arc shape, and the sectional shape in the conveyance direction of the container is made a shape in which the upper-end corner part thereof in the end portions on the upstream side and the downstream side in the conveyance direction of the container is curved in the arc shape, whereby the superheated steam does not remain in an inlet portion and an outlet portion of the container in the cover, the flow of the superheated steam becomes smooth, thereby the atmospheric temperature in the cover is made uniform, and even if dew condensation is generated, the condensed water flows down along the cover inner surface and thus, the condensed water does not drop into the container.

Moreover, since the container enters into the cover with cold air, dew condensation can easily occur on the upstream side in the conveyance direction of the container in the cover. However, by providing the steam discharge portion for discharging the superheated steam upward on the upstream side in the conveyance direction of the container in the cover and by supplying the superheated steam to the upstream side in the conveyance direction of the container in the steam discharge unit, the atmospheric temperature on the upstream side in the conveyance direction of the container in the cover is less likely to reduce, and then, dew condensation is less likely to generate on the upstream side in the conveyance direction of the container in the cover.

Moreover, in the above-mentioned embodiment, in order to prevent the condensed water entering into the container passing through the cover, the supply of the container into the cover is preferably started after 10 minutes have elapsed since the point of time that the temperature in the cover has reached 160° C. However, this is not a limitation, the temperature in the cover or the elapsed time to be an index (reference) of supply start timing of the container into the cover needs to be set as appropriate in accordance with the constructional conditions of the apparatus, so that the dew condensation is not generated on the portion immediately above the conveyance path of the container on the inner surface in the cover or on the portion immediately above the steam discharge unit disposed on the both sides of the conveyance path of the container.

In said drying zone ZB, a heated-air generating heat exchanger 15 of a fin tube type is incorporated in both sides in the width direction of the conveyer C, a heated-air blowing unit 14 in which a plurality of air blow-out openings 14*a* for discharging the heated air at a predetermined temperature are formed, a steam header 16 connected to a tube of the heated-air generating heat exchanger 15, and an air nozzle 17 for discharging steam inside the container PC by blowing air into the container PC from an upper opening portion of the container PC are provided, and the heated air at the predetermined temperature is generated by passage of the air introduced into the heated-air blowing unit 14 through the heated-air generating heat exchanger 15 and is blown out toward a periphery of the container PC from the air blow-out opening 14*a*.

Figure 3:
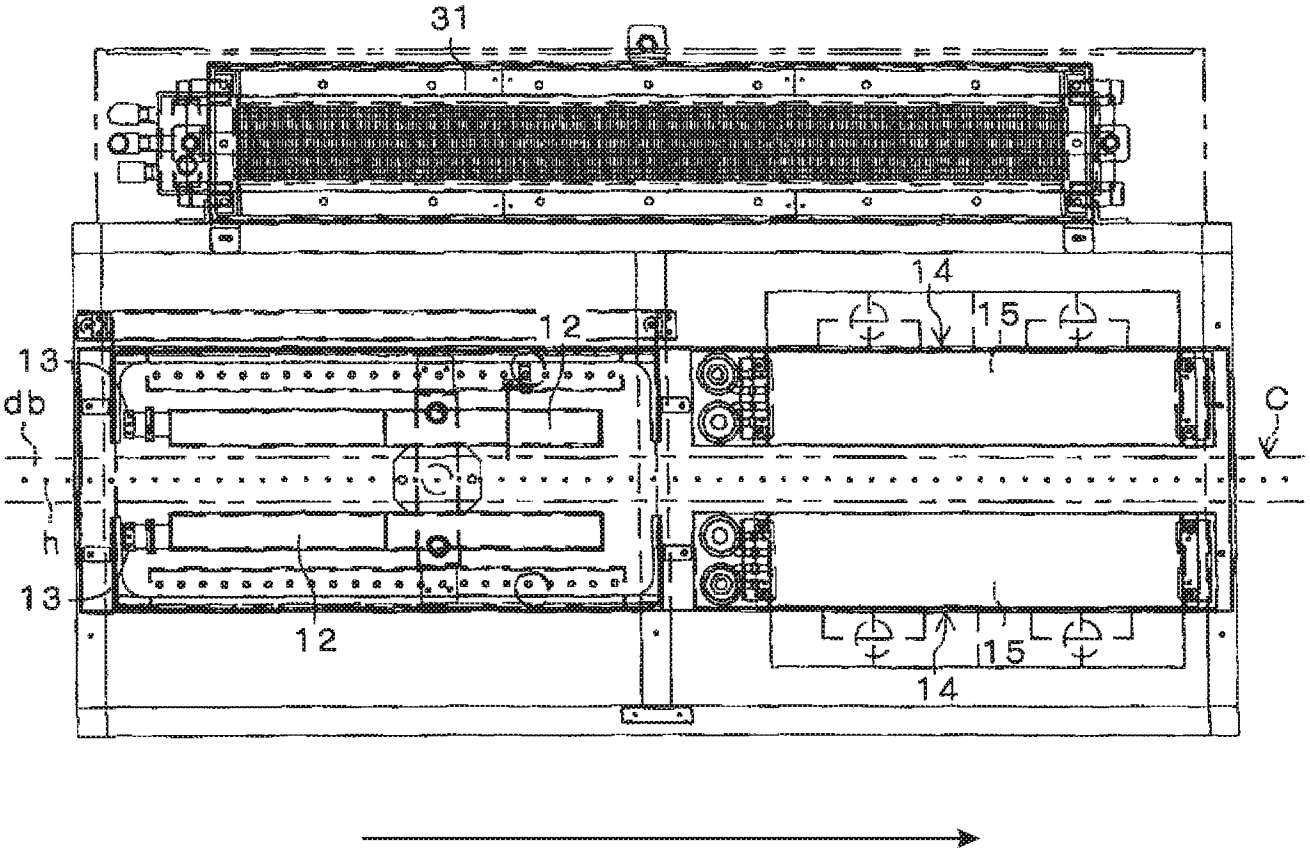
FIG. 3 is a plan view illustrating the above mentioned heating treatment chamber.

Moreover, the conveyer C includes, as shown in FIG. 3, a conveyance belt db, on which the container PC is placed to which container the cylindrical label L is fitted, in which belt a large number of suction holes h are formed at a predetermined pitch in the conveyance direction, and immediately below this conveyance belt db, a suction box 18 a top surface of which is opened is provided and is connected to a container holding blower 29 which will be described later. Therefore, the container PC being mounted on the conveyance belt db is suctioned and held on the conveyance belt db by means of the suction holes h being portioned so that the container does not trip easily.

Figure 6:
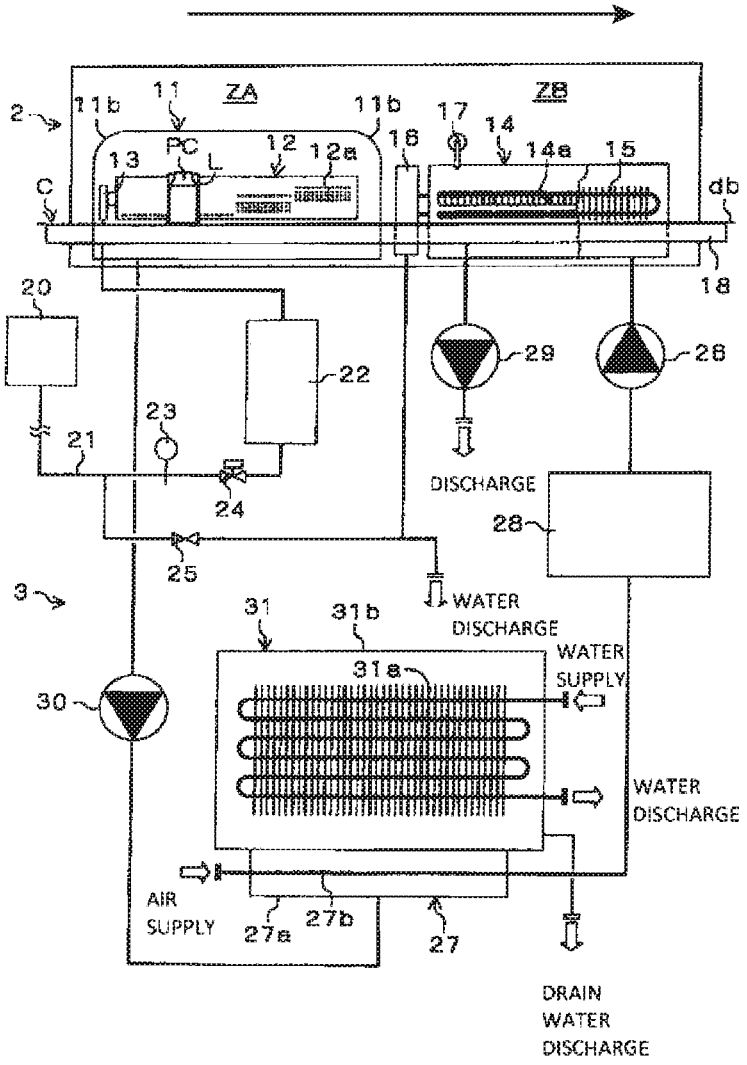
FIG. 6 is an outline constructional diagram illustrating the above-mentioned heat-shrinking apparatus.

As shown in FIG. 6, the device integrated portion 3 includes a steam pipeline 21 for supplying the steam generated by a steam boiler 20, a superheater 22 for generating superheated steam at approximately 160 to 180° C. by heating the steam supplied by this steam pipeline 21, a pressure sensor 23 for detecting a steam supply pressure of the steam supplied by the steam pipeline 21, an electric valve 24 for opening/closing a steam supply path in accordance with the steam supply pressure detected by the pressure sensor 23 in order to supply a predetermined flowrate of steam to the superheater 22, a pressure control valve 25 for controlling a supply pressure of the steam to the steam header 16, a drying blower 26 for supplying the air for generating heated air to the heated-air blowing unit 14, a preheating unit 27 and a filter unit 28 provided on the upstream side of the drying blower 26, a container holding blower 29 for discharging the air in the suction box 18, a discharging blower 30 for supplying surplus steam in the heat-shrinking zone ZA to the preheating unit 27, and a condensing heat exchanger 31 for condensing the surplus steam used for preheating the air for generating heated air.

Said preheating unit 27 is constructed by a chamber 27*a* extending in the conveyance direction of the container PC provided on a lower part on the back surface side and four copper pipes 27*b* which penetrate this chamber 27*a* in the conveyance direction of the container PC and through which the air for generating heated air is passed, and the surplus steam in the heat-shrinking zone ZA being supplied by a discharge blower 30 is supplied to the condensing heat exchanger 31 provided on the upper part of the preheating unit 27 via the chamber 27*a*. Therefore, the air for generating heated air is heat-exchanged with the surplus steam in the chamber 27*a* while passing through the copper pipes 27*b* and is supplied to the heated-air blowing unit 14 in a preheated condition (preheated state).

The condensing heat exchanger 31 is constructed by a heat exchanger body 31*a* of a fin tube type and a casing 31*b* accommodating this heat exchanger body 31*a*, and service water is supplied to a tube of the heat exchanger body 31*a*, and the surplus steam having passed through the chamber 27*a* of the preheating unit 27 is supplied into the casing 31*b*. Therefore, the surplus steam being supplied into the casing 31*b* is condensed by heat exchange with the service water having passed through the tube of the heat exchanger body 31*a* and is discharged as drain water from an outlet mounted on a lower part of the casing 31*b*.

As described above, in this heat-shrinking apparatus 1, since the cylindrical label L fitted to the barrel part of the container PC is heat-shrunk by the superheated steam at approximately 160 to 180° C. being supplied to the heat-shrinking zone ZA of the heating treatment chamber 2, similarly to the case of heating by the steam, the design or character printed on the shrink label is not distorted easily but can be finished beautifully.

Moreover, though the steam can be easily condensed and emit latent heat (enthalpy of evaporation), the superheated steam is not condensed at all until its temperature falls to a saturation temperature while only a part of the enthalpy is reduced, unlike the case of heating by the steam, and thus, water drops are not deposited generally on the surface of the container PC or the cylindrical label L. However, there is a possibility that the temperature of the superheated steam supplied into the heating treatment chamber 2 falls equal to or lower than the saturation temperature by contact with the surface of the container PC or the cylindrical label L, and a few water drops are deposited on the surface of the container PC or the cylindrical label L.

However, in this heat-shrinking apparatus 1, in the drying zone ZB on the downstream side of the heat-shrinking zone ZA in the heating treatment chamber 2, the air nozzle 17 blows air into the container PC from the upper opening portion of the container PC, whereby the steam inside the container PC is discharged, and even if a few water drops are deposited on the inner surface of the container PC, the water drops are evaporated. Moreover, by blowing of the heated air at the predetermined temperature by the heated-air blowing unit 14, even if a few water drops are deposited on the outer surface of the container PC or the cylindrical label L, the water drops are evaporated. Therefore, in a condition (state) that no water drops are deposited on the surface of the container PC, the cylindrical label L or the inner surface of the container PC, the container PC to which the cylindrical label L is attached can be delivered to the liquid drink filling process.

Moreover, the thickness of the cover in the heating treatment chamber is changed from 1.2 mm to 1.5 mm, and the shape is changed to a dome shape having a sectional shape in the direction orthogonal to the conveyance direction of the container with the upper half curved in the semi-arc shape and having a sectional shape in the conveyance direction of the container with the upper-end corner part on the end portions on the upstream side and the downstream side in the conveyance direction of the container being curved in the arc shape. In addition, the steam discharge nozzle in the steam discharge unit of the superheated steam is disposed on the upstream side in the cover so as to discharge the superheated steam upward and is changed to supply the superheated steam to the upstream side in the conveyance direction of the container in the steam discharge unit. By means of these changes, dew condensation which might be dripped to the container from the cover can be prevented. Moreover, by starting supply of the container into the cover after 10 minutes have elapsed since the point of time that the temperature in the cover reached 160° C., generation of dew condensation which might be dripped to the container on the downstream side in the cover can be further suppressed.

Moreover, in this heat-shrinking apparatus 1, the preheating unit 27 is constructed such that the air for generating heated air is preheated by using the surplus steam in the heat-shrinking zone ZA in the heating treatment chamber 2, the heated air at the predetermined temperature blowing to the container PC or the cylindrical label L for evaporating a few water drops being deposited on the container PC or the cylindrical label L can be efficiently generated, and energy efficiency is also good.

Moreover, in a case that the surplus steam is discharged to the outside as it is, the surplus steam is emitted to outdoors in a condition being smoky state from a funnel. However, since the heat-shrinking apparatus 1 condenses the surplus steam after its use for preheating the air for generating heated air by passing it through the condensing heat exchanger 31 for cooling, the surplus steam can be discharged as drain water, and thus, there are merits that the outside appearance is better than a case that discharge of the surplus steam to the outside in the state as it is, and that a discharge duct or the like for discharging the surplus steam is no longer necessary.

Moreover, since a temperature of the drain water as the result of condensing the surplus steam is at 70 to 80° C. and a temperature of the service water for cooling supplied to the condensing heat exchanger 31 is raised to approximately 50° C. by heat exchange with the surplus steam, generation efficiency of steam can be further improved, by supplying such drain water or warm water to the steam boiler 20 for reuse.

Moreover, as described above, by setting the supply temperature of the superheated steam to be supplied into the heating treatment camber 2 to a temperature being largely higher than the vicinity of 100° C. which is a heat-shrinking temperature for heat-shrinking the cylindrical label L to a limit shrinking rate of the shrink label forming the cylindrical label L, that is, for example approximately to 160 to 180° C., heat-shrinking is carried out to the required shrinking rage rapidly after the entry of the cylindrical label L fitted to the container PC into the heating treatment chamber 2, as compared with a case of heating by heated air at the same temperature and a case of heating by steam at the same temperature, the passage time through the heating treatment chamber can be extremely shortened, thus, there is a merit that the length of the heat-shrinking zone ZA in the heating treatment chamber 2 can be shortened, a necessary space to provide the entire apparatus can be small, and the steam supply quantity can be made smaller than a case that heating is carried out by steam.

In the above-mentioned embodiment, in the drying zone ZB in the heating treatment chamber 2, the steam in the container PC is discharged by blowing of the air from the air nozzle 17 into the container PC, however, there is no limitation and the air nozzle 17 can be omitted.

Moreover, in the above-mentioned embodiment, the case is described in which the cylindrical label L is attached to the barrel part of the container PC before the liquid drink is filled, and then the liquid drink is filled in the container PC after attaching and sealing the label L to the container PC. However, there is no limitation, the present invention can be applied to the case that the label is attached to the container in which the contents are already filled and sealed. Particularly, it is suitable for food in a cup for which moisture should be avoided, paper containers, containers to which a paper label is attached and the like.

INDUSTRIAL APPLICABILITY

The present invention can be applied to cases for heat-shrinking of shrink labels, a packing material or the like covering a part of or the whole of an article.

REFERENCE SIGNS LIST

1 heat-shrinking apparatus
2 heating treatment chamber
2*a* door
3 device integrated portion
4 control panel
11 cover
12 steam discharge unit (steam supply device)
12*a* discharge hole

13 steam discharge nozzle
14 heated air blowing unit (heated air blowing device)
14*a* air blow-out opening
15 heated-air generating heat exchanger (heating device)
16 steam header
17 air nozzle
18 suction box
20 steam boiler (steam supply device)
21 steam pipeline (steam supply device)
22 superheater (steam supply device)
23 pressure sensor (steam supply device)
24 electric valve (steam supply device)
25 pressure control valve
26 drying blower
27 preheating unit (preheating device)
27*a* chamber
27*b* copper pipe
28 filter unit
29 container holding blower
30 discharge blower
31 condensing heat exchanger (steam condensing device)
31*a* heat exchanger body
31*b* casing
C conveyer
L cylindrical label
db conveyance belt
h suction hole
PC plastic container
ZA heat-shrinking zone
ZB drying zone

The invention claimed is:

1. A heat-shrinking apparatus for shrink labels, comprising a heating treatment chamber which, comprises a cover surrounding a conveyance path of a label covered body in which a part of or a whole of an article is covered by a shrink label, a heat-shrinking zone for heating by superheated steam so as to heat-shrink the label being covered to the label covered body and a drying zone for blowing heated air in order to evaporate water drops deposited on the label covered body to which the label is attached by heat-shrinking, the heat-shrinking apparatus further comprising:

a steam supply device for supplying superheated steam into a steam discharge unit being provided in the heat-shrinking zone of the heating treatment chamber and positioned in the cover surrounding the conveyance path, in order to heat-shrink the shrink label on the label covered body passing through the steam discharge unit;

a heated air blowing device being provided in the drying zone in order to evaporate water drops by blowing the heated air to the label covered body on the periphery thereof onto which the water drops are deposited due to passage through the steam discharge unit to which the superheated steam is supplied; and a heated air generating device for generating heated air at a predetermined temperature which are blown by the heated air blowing device, the heated air generating device including a heated-air generating heat exchanger for generating the heated air at the predetermined temperature from air introduced into the heated-air blowing unit, and the cover having a region on an inner surface thereof immediately above the conveyance path of the label covered body and at least another region on the inner surface thereof that is curved immediately above the steam discharge unit, the cover having a dome shape and a sectional shape in a direction orthogonal to the conveyance direction of the label covered body is a shape such that an upper part is curved as a semi-arc shape, and a sectional shape of the cover in the conveyance direction of the label covered body is a shape including upper-end corner parts on both end portions, which when the cover is viewed in a side elevational view in the longitudinal direction, have corner parts that are curved in an arc shape to prevent the water drops from dropping into the label covered body, wherein at least one of the curved corner parts is above at least a portion of the steam discharge unit in an upstream side of the steam discharge unit, and wherein the portion of the steam discharge unit is provided so that a part of the superheated steam discharged therefrom is capable of flowing towards at least one of the curved corner parts and is capable of preventing generation of condensation on the upstream side in the cover.

2. The heat-shrinking apparatus for shrink labels according to claim 1, further comprising:

a steam condensing device that condenses the surplus steam in the heating treatment chamber by cooling.

3. The heat-shrinking apparatus for shrink labels according to claim 2, further comprising:

a preheating unit for preheating air by the surplus steam in the heat-shrinking zone.

4. The heat-shrinking apparatus for shrink labels according to claim 3, wherein a temperature of the superheated steam being supplied into the steam discharge unit in the cover is 160 to 180° C., and wherein a controller supplies the label covered body into the cover after 10 minutes after a point of time when the temperature in the cover reaches 160° C.

5. The heat-shrinking apparatus for shrink labels according to claim 2, wherein a temperature of the superheated steam being supplied into the steam discharge unit in the cover is 160 to 180° C., and wherein a controller supplies the label covered body into the cover after 10 minutes after a point of time when the temperature in said cover reaches 160° C.

6. The heat-shrinking apparatus for shrink labels according to claim 1, further comprising:

a preheating unit for preheating air by the surplus steam in the heat-shrinking zone.

7. The heat-shrinking apparatus for shrink labels according to claim 6, wherein a temperature of the superheated steam being supplied into the steam discharge unit in the cover is 160 to 180° C., and wherein a controller supplies the label covered body into the cover after 10 minutes after a point of time when the temperature in the cover reaches 160° C.

8. The heat-shrinking apparatus for shrink labels according to claim 1, wherein a temperature of the superheated steam being supplied into the steam discharge unit in the cover is 160 to 180° C., and wherein a controller supplies the label covered body into the cover at a starting time after 10 minutes after a point of time when the temperature in the cover reaches 160° C.

* * * * *